US007497364B2

(12) United States Patent
Lee

(10) Patent No.: US 7,497,364 B2
(45) Date of Patent: Mar. 3, 2009

(54) ADJUSTING DEVICE FOR MAGAZINE OF NAILERS

(76) Inventor: Yi-Kuan Lee, No. 113, Lane 60, Gong-Jiew Street, Ta-Li City, Taichung County (TW) 412

( * ) Notice: Subject to any disclaimer, the term of this patent is extended or adjusted under 35 U.S.C. 154(b) by 0 days.

(21) Appl. No.: 11/899,746

(22) Filed: Sep. 8, 2007

(65) Prior Publication Data

US 2008/0061104 A1 Mar. 13, 2008

(30) Foreign Application Priority Data

Sep. 8, 2006 (TW) ..... 95216098 U

(51) Int. Cl.
*B25C 1/04* (2006.01)

(52) U.S. Cl. ..... 227/109; 227/120

(58) Field of Classification Search ..... 227/109, 227/119, 120, 136, 8
See application file for complete search history.

(56) References Cited

U.S. PATENT DOCUMENTS 4,815,647 A * 3/1989 Chou ..... 227/109
5,096,109 A * 3/1992 Chen ..... 227/109
5,588,577 A * 12/1996 Chen ..... 227/120
5,934,539 A * 8/1999 Lee ..... 227/109
6,161,746 A * 12/2000 Wey ..... 227/109
6,564,985 B1 * 5/2003 Chou ..... 227/109
6,644,530 B2 * 11/2003 Chen ..... 227/109
6,715,657 B2 * 4/2004 Chen ..... 227/120
6,729,523 B1 * 5/2004 Wang et al. ..... 227/120
6,851,594 B1 * 2/2005 Huang ..... 227/109
7,004,368 B1 * 2/2006 Chen ..... 227/120
7,048,169 B2 * 5/2006 Sun ..... 227/120

* cited by examiner

*Primary Examiner*—Scott A. Smith

(57) ABSTRACT

A magazine includes a base having nail slots defined therein and a cover is slidably mounted to the base. A first end member and a second end member are respectively connected to the first and second ends of the cover. A plurality of rods extend through the first end member, the nail slots and the second end member. Each rod has a biasing member and a pushing member which is biased by the biasing member so as to push the nails in the nail slots. A plurality of bolts extend through the second end member and contact against the second end of the cover so that when rotating the bolts to move the second end member away from the second end of the cover, the rods are straightened. The pushing members on the rods push the nails of different lengths to be arranged in order in the magazine.

7 Claims, 6 Drawing Sheets

ADJUSTING DEVICE FOR MAGAZINE OF NAILERS

FIELD OF THE INVENTION

The present invention relates to a magazine assembly for a pneumatic nailer and the adjusting device arranges the nails of different lengths in order.

BACKGROUND OF THE INVENTION

A conventional magazine for a pneumatic nailer generally includes a groove for receiving nails and a pushing member is pushed by a spring so as to feed the nails into the barrel of the nailer one by one. Due to the nails have different sizes and lengths so that the magazine has a corresponding adjustment device for position the nails in order. However, the conventional magazines cannot properly adjust the groove for the nails of different lengths so that the nails are inclinedly received in the magazine if the width of the groove is longer than the nails, and the nails cannot be easily put in the magazine if the width of the groove is shorter than the nails. Once the nails are not properly positioned in the magazine, the nails might be stocked in the barrel.

The present invention intends to provide an adjusting device for a magazine of pneumatic nailers and the device includes a plurality of pushing members movably mounted on the rods in the magazine, the rods are located at different positions to meet the nails of different lengths so that the nails of different lengths can be arranged in order in the magazine.

SUMMARY OF THE INVENTION

The present invention relates to a magazine for a pneumatic nailer and comprises a base having two guide rails on two sides thereof and a plurality nail slots are defined in the base and located between the guide rails. A cover is slidably mounted to the base by engaging the two guide rails in two guide grooves. A space area is defined in an inside of the cover and two first positioning means are located at a first end of the cover and a second positioning member is located at a second end of the cover. A first end member is connected to the first end of the cover and the second end member is connected to the second end of the cover. The first end member includes two first connection means which are connected with the two first positioning means of the cover. The second end member includes a second connection means which is connected with the second positioning means of the cover. A plurality of rods extend through the first through holes in the first end member and the second through holes in the second end member. Each rod has a biasing member and a pushing member which is moved in the space area.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
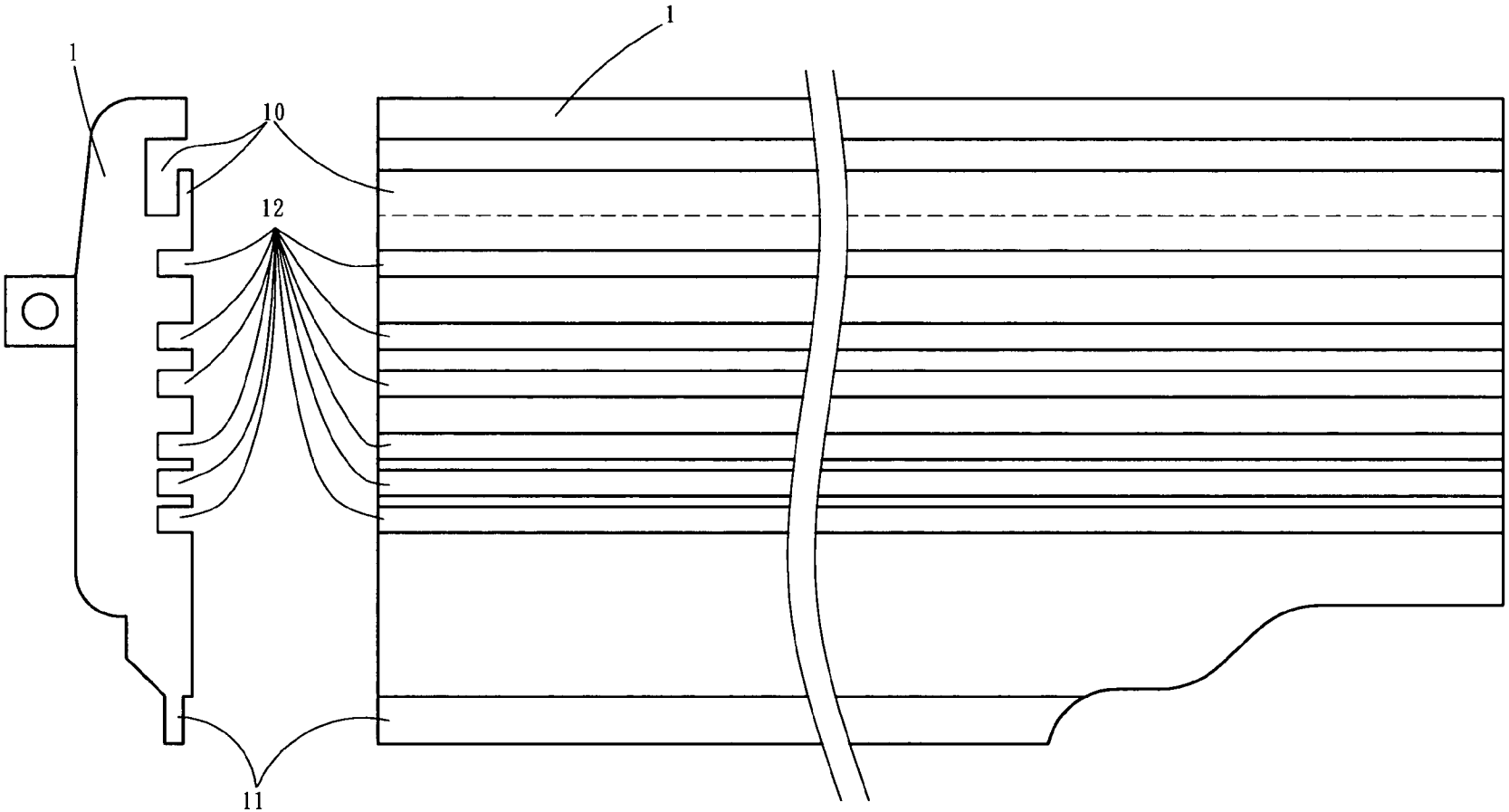
FIG. 1 shows the base of the magazine of the present invention.
Figure 2:
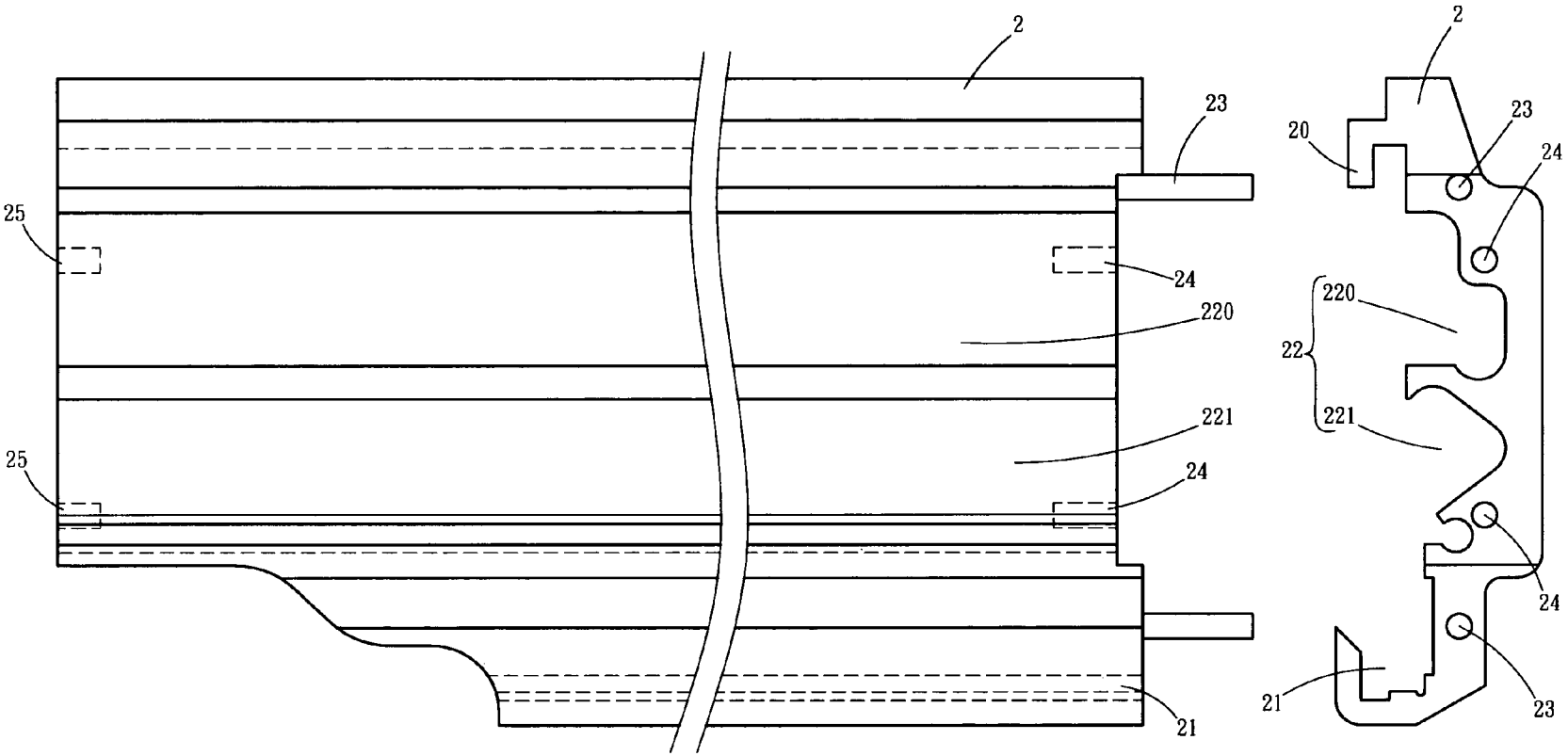
FIG. 2 shows the cover of the magazine of the present invention.
Figure 5:
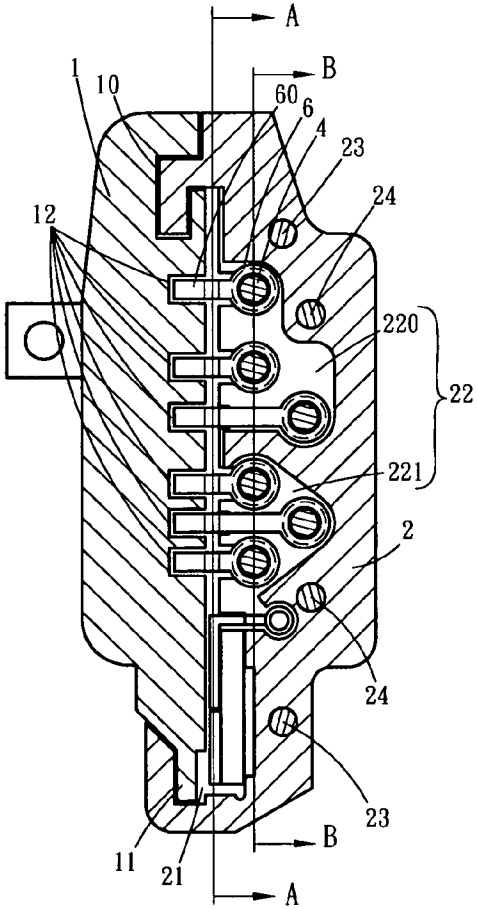
FIG. 5 shows an end cross sectional view of the magazine of the present invention.
Figure 4:
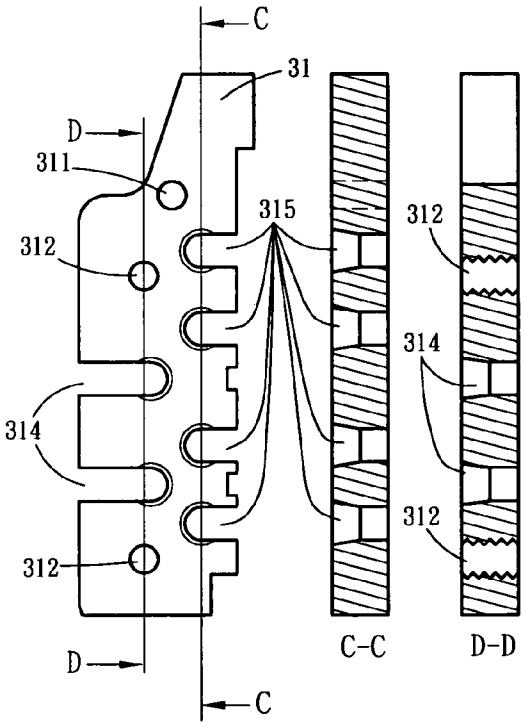
FIG. 4 is a partial cross sectional view to show the second end member of the magazine of the present invention.
Figure 3:
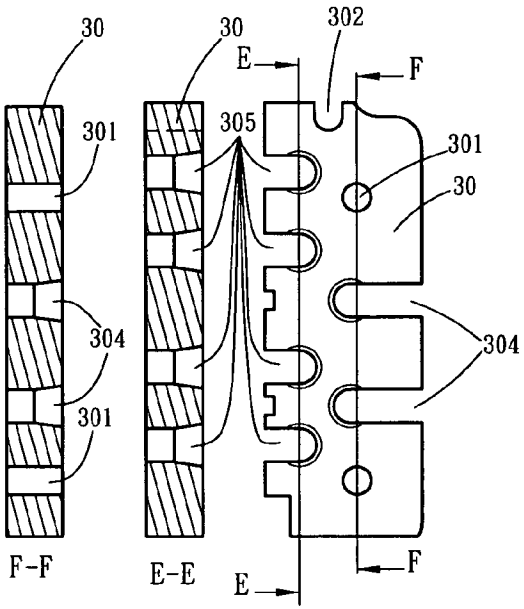
FIG. 3 is a partial cross sectional view to show the first end member of the magazine of the present invention.

Referring to FIGS. 1 to 7, the magazine of the present invention comprises a base 1 having two guide rails 10, 11 on two sides thereof and a plurality nail slots 12 are defined in the base 1 and located between the guide rails 10, 11. A cover 2 has two guide grooves 20, 21 in which the two guide rails 10, 11 are movably engaged so that the cover 2 is slidably mounted to the base 1. A space area 22 is defined in an inside of the cover 2 and includes a first space 220 and a second space 221. The space area 22 is located corresponding to the nail slots 12 of the base 1. Two first positioning means 23, 24 are located at a first end of the cover 2 and a second positioning member 25 is located at a second end of the cover 2.

An end member unit 3 includes a first end member 30 and a second end member 31, wherein the first end member 30 is connected to the first end of the cover 2 and the second end member 31 is connected to the second end of the cover 2. The first end member 30 includes two first connection means 301, 302 which are connected with the two first positioning means 23, 24 of the cover 2. The second end member 31 includes a second connection means 311 which is connected with the second positioning means 25 of the cover 2. The first end member 30 includes a plurality of first through holes 304, 305 and the second end member 30 includes a plurality of second through holes 314, 315. A plurality of rods 4 extend through the first through holes 304, 305 and the second through holes 314, 315. Each rod 4 has a biasing member 5 and a pushing member 6 which is biased by the biasing member 5 and moves along the rod 4 so as to push the nails in the space area 22.

There are two ways to connect the first and second end members 30, 31 to the cover 2. The first way is that each of the first positioning means 23, 24 and the second positioning means 25 is a protrusion and each of the first connection means 301, 302 and the second connection means 311 is a recess, the protrusions are inserted into the recesses. The other way is that each of the first positioning means 23, 24 and the second positioning means 25 is a recess and each of the first connection means 301, 302 and the second connection means 311 is a protrusion, the protrusions are inserted into the recesses.

Each of the first positioning means 23, 24 and the second positioning means 25 is a hole each of the first connection means 301, 302 and the second connection means 311 is a hole. The rods 4 extend through the aligned holes of the first positioning means 23, 24, the second positioning means 25, the first connection means 301, 302 and the second connection means 311. The second end member 302 includes threaded holes 312 and bolts 7 are threadedly connected to the threaded holes 312. The bolts 7 contacts the second end of the cover 2 so as to move the second end member 302 away from the second end of the cover 2 to straighten the rods 4.

Figure 6:
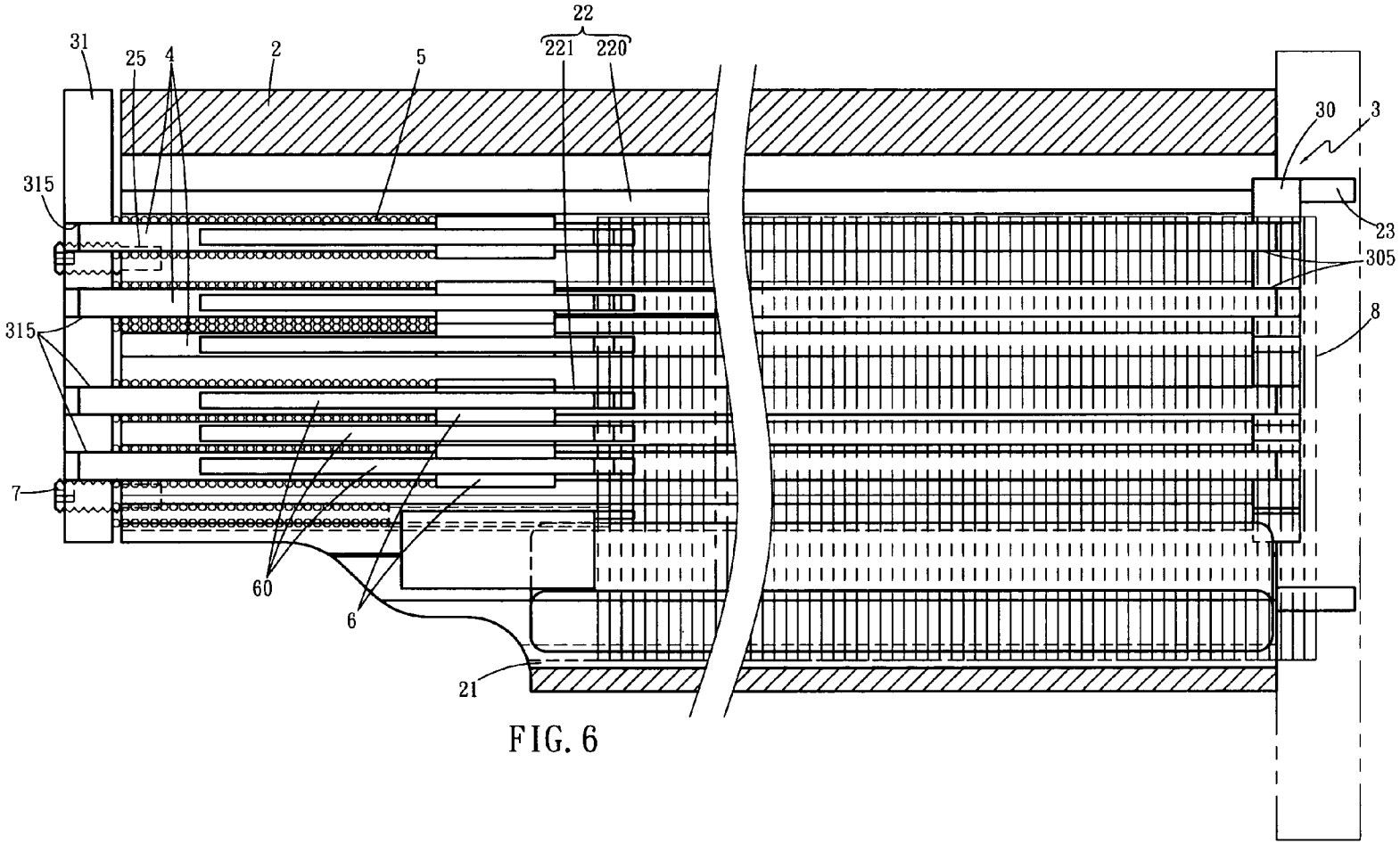
FIG. 6 is a cross sectional view taken along A-A in FIG. 5.
Figure 7:
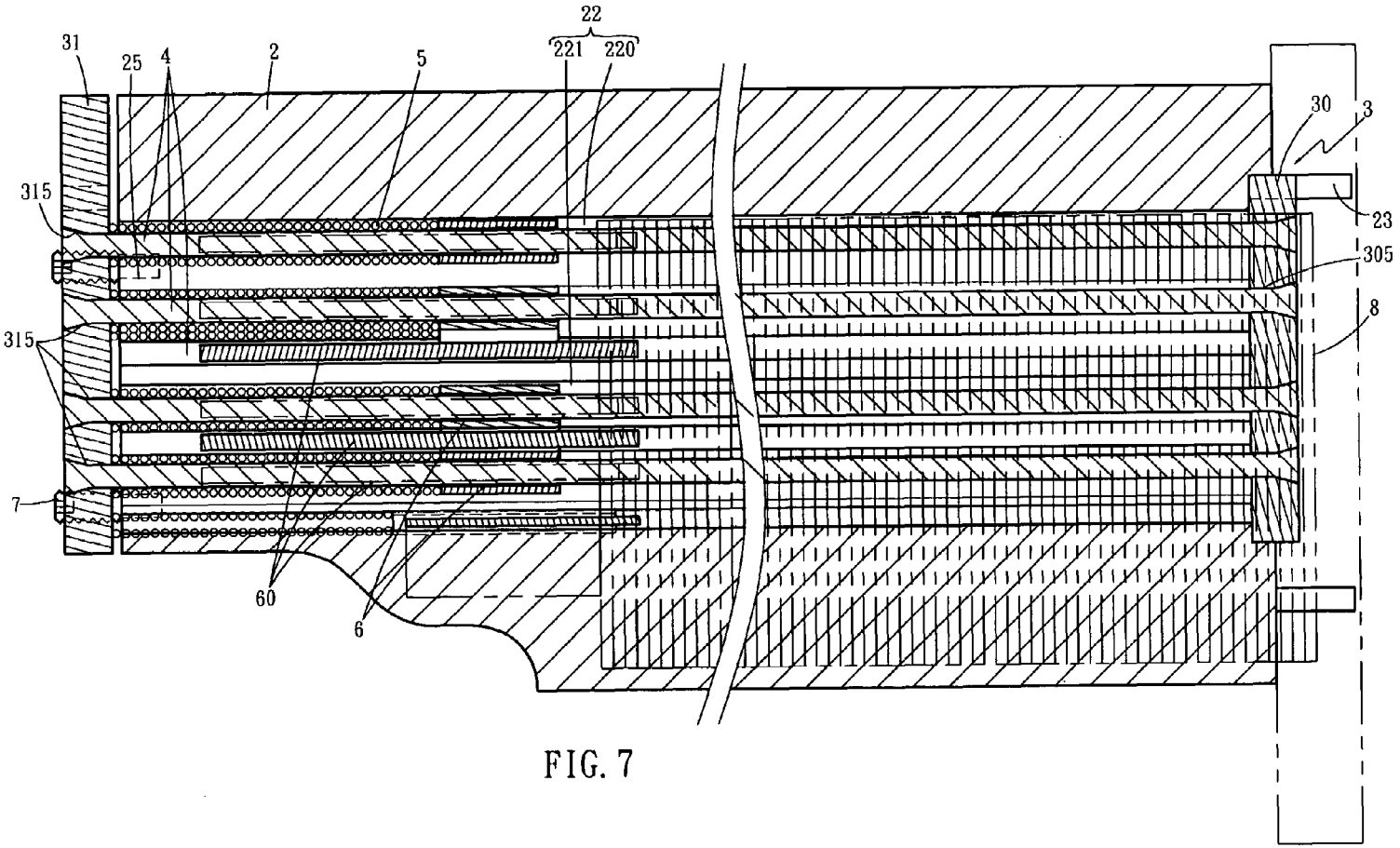
FIG. 7 is a cross sectional view taken along B-B in FIG. 5.

The cover 2 is slid to open the magazine and long nails 8 are inserted in the nail slots 12, the cover 2 is then slid to close the magazine. The pushing ends 60 of the pushing member 6 are moved by the biasing members 5 and moved in the nail slots 12 to push the nails 8 as shown in FIG. 6, so that the long nails 8 are arranged in order.

Figure 8:
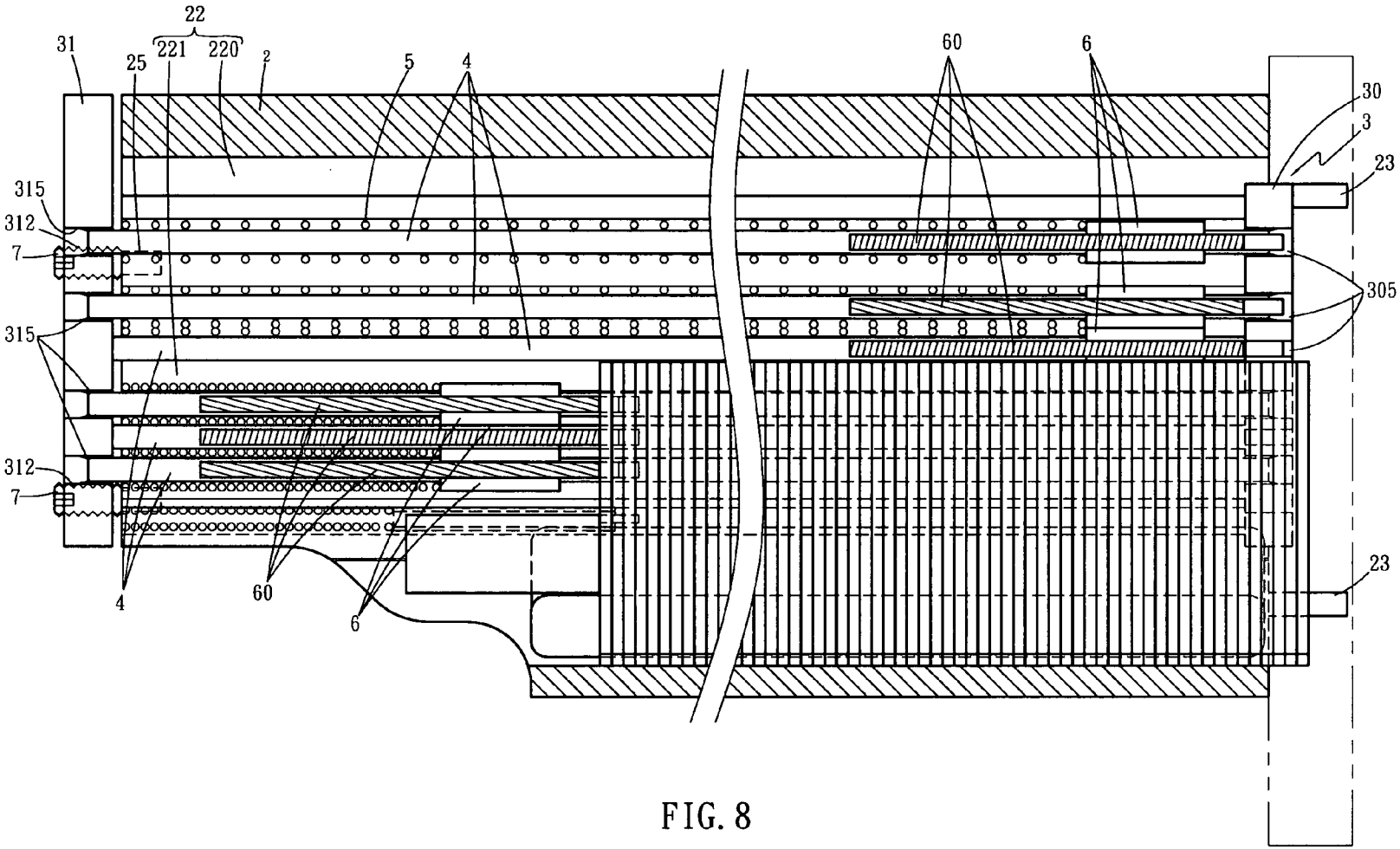
FIG. 8 shows that nails of different lengths are installed in the magazine.

When short nails 8 are inserted in the nail slots 12, the pushing ends 60 of some of the pushing members 6 are moved by the biasing members 5 and moved in the nail slots 12 to push the nails 8 as shown in FIG. 8, so that the long nails 8 are arranged in order.

While we have shown and described the embodiment in accordance with the present invention, it should be clear to those skilled in the art that further embodiments may be made without departing from the scope of the present invention.

What is claimed is:

1. A magazine comprising:

a base having two guide rails on two sides thereof and a plurality nail slots defined in the base and located between the guide rails;

a cover having two guide grooves in which the two guide rails are movably engaged, a space area defined in an inside of the cover and two first positioning means located at a first end of the cover and a second positioning members located at a second end of the cover;

an end member unit including a first end member and a second end member, the first end member connected to the first end of the cover and the second end member connected to the second end of the cover, the first end member including two first connection means which are connected with the two first positioning means of the cover, the second end member including a second connection means which is connected with the second positioning means of the cover, the first end member including a plurality of first through holes and the second end member including a plurality of second through holes, and a plurality of rods extending through the first through holes and the second through holes, each rod having a biasing member and a pushing member which is moved in the space area.

2. The magazine as claimed in claim 1, wherein each of the first positioning means and the second positioning means is a protrusion and each of the first connection means and the second connection means is a recess, the protrusions are inserted into the recesses.

3. The magazine as claimed in claim 1, wherein each of the first positioning means and the second positioning means is a recess and each of the first connection means and the second connection means is a protrusion, the protrusions are inserted into the recesses.

4. The magazine as claimed in claim 1, each of the first positioning means and the second positioning means is a hole each of the first connection means and the second connection means is a hole, the rods extend through the aligned holes of the first positioning means, the second positioning means, the first connection means and the second connection means.

5. The magazine as claimed in claim 1, wherein the nail slots of the base are located corresponding to the space area of the cover.

6. The magazine as claimed in claim 5, wherein the space includes a first space and a second space.

7. The magazine as claimed in claim 1, wherein the second end member includes threaded holes and bolts are threadedly connected to the threaded holes, the bolts contacts the second end of the cover so as to move the second end member away from the second end of the cover to straighten the rods.

* * * * *